US012414639B2

(12) United States Patent
Pankratz

(10) Patent No.: US 12,414,639 B2
(45) Date of Patent: Sep. 16, 2025

(54) SEAT STRUCTURE FOR INFANT

(71) Applicant: NUVATE INC., Oakville (CA)

(72) Inventor: Stephen Pankratz, Oakville (CA)

(73) Assignee: NUVATE INC., Oakville (CA)

( * ) Notice: Subject to any disclaimer, the term of this patent is extended or adjusted under 35 U.S.C. 154(b) by 281 days.

(21) Appl. No.: 18/349,613

(22) Filed: Jul. 10, 2023

(65) Prior Publication Data

US 2024/0016308 A1 Jan. 18, 2024

Related U.S. Application Data

(60) Provisional application No. 63/389,186, filed on Jul. 14, 2022.

(51) Int. Cl.

| | |
|---|---|
| ***A47D 1/00*** | (2006.01) |
| ***A47D 1/10*** | (2006.01) |
| ***A47D 13/00*** | (2006.01) |

(52) U.S. Cl.

CPC ..... *A47D 1/0085* (2017.05); *A47D 1/10* (2013.01); *A47D 13/00* (2013.01)

(58) Field of Classification Search

CPC ..... A47D 1/0085; A47D 1/10; A47D 13/00
See application file for complete search history.

(56) References Cited

U.S. PATENT DOCUMENTS 2,736,364 A * 2/1956 Janus ..... A47D 15/006 297/229
2,938,574 A * 5/1960 Brown ..... A47D 15/00 297/182
4,094,547 A * 6/1978 Zampino ..... A47D 1/008 297/182
5,549,353 A * 8/1996 Gaudet ..... B60N 2/2824 297/256.16
6,000,753 A * 12/1999 Cone, II ..... B60N 2/2821 297/256.16
6,523,793 B1 * 2/2003 Higgins ..... A47D 1/00 248/102

(Continued)

FOREIGN PATENT DOCUMENTS

WO 0065965 A1 11/2000

*Primary Examiner* — David R Dunn
*Assistant Examiner* — Tania Abraham
(74) *Attorney, Agent, or Firm* — Bhole IP Law; Anil Bhole; Chris Dynowski

(57) ABSTRACT

A seat structure for a baby or young infant that can facilitate an anterior pelvic tilt and hip abduction, while supporting the infant in an upright position. The infant seat structure described herein comprises a seat that is forward tilted. A pommel is provided at a forward edge of the seat that is wide enough to splay the infant's legs, provides support for the infant, and maintains their position in the seat structure. The infant seat structure also includes a back support and side supports to support the infant's/baby's upright position. The side supports do not extend substantially forward past the infant's hip joints, and therefore allow for substantial splaying of their legs. An infant's legs are able to project outwardly from the seat structure on either side of the pommel, through the two spaces that are each situated between the pommel and side supports. A mat is placed beneath the base and a tether is secured between the mat and seat to inhibit the child imparting a tipping force to the seat.

10 Claims, 7 Drawing Sheets

(56) References Cited

U.S. PATENT DOCUMENTS

| | | | | |
|---|---|---|---|---|
| 10,952,541 | B2 | 3/2021 | Pankratz | |
| 2003/0034677 | A1 * | 2/2003 | Marshall | B60N 2/28<br>297/256.16 |

* cited by examiner

SEAT STRUCTURE FOR INFANT

FIELD OF THE INVENTION

The present invention relates to a seat structure suitable for use by an infant.

BACKGROUND OF THE INVENTION

PCT/ZA1999/00030 describes a supporting chair that enables a young or small baby who cannot sit up safely by him or herself without assistance, to be stably propped in a sitting position. This has several advantages. It can provide a convenient means for a parent/caregiver to feed the baby using both of his or her hands. It can also satisfy the infant's desire to explore his or her environment from a sitting (instead of laying down) position.

The device described in PCT/ZA1999/00030 is a baby supporting chair which comprises a seat, a backrest, two side supports, and a front support. Between the front support and the side supports there are two grooves for the baby's legs to project outwardly forward from the seat. The seat of the chair is at a level equal to or lower than the level of the bottoms of the two grooves. This results in the seated infant's pelvis being positioned in a posteriorly tilted orientation. Many experts believe however that while the baby/young infant is sitting, it's preferable for their pelvis to be positioned in an anterior pelvic tilt which promotes proper spinal alignment, engages their core muscles and encourages better posture. A variety of sitting wedges are available that accomplish this. However these wedges do not provide sufficient support to keep a young infant in an upright position.

In addition, the side supports of the invention described in PCT/ZA1999/00030 and many floor seats commercially available cause hip adduction (especially in larger/older infants), which can lead to hip dysplasia. Many experts feel that positions that instead encourage hip abduction in young infants is much preferred.

U.S. Pat. No. 10,952,541 relates to a seat structure for a baby or young infant that can facilitate an anterior pelvic tilt and hip abduction, while supporting the infant in an upright position. The infant seat structure described comprises a seat that is forward tilted. A pommel is provided at a forward edge of the seat that is wide enough to splay the infant's legs, provides support for the infant, and maintains their position in the seat structure. The infant seat structure also includes a back support and side supports to support the infant's/baby's upright position. The side supports do not extend forward past the infant's hip joints, and therefore allow for substantial splaying of their legs. An infant's legs are able to project outwardly from the seat structure on either side of the pommel, through the two spaces that are each situated between the pommel and side supports. When the seat is on the floor, the outer surfaces of the sitting infant's feet/ankles/heels are able to rest in front of the seat on the floor. This encourages bending of the knees and splaying of the infant's legs with external hip rotation and abduction.

The seat structure has a fastening mechanism, which secures the infant in place and/or prevents the infant from falling out. This is particularly important because the infant will be sitting upright with their core muscles engaged, and with a heightened center of gravity.

The commercial version of the seat structure incorporates a tray that is removably supported on the pommel. The tray is secured to the seat by a leg that extends from the lower edge of the base to the underside of the tray and is attached to the tray by resilient fingers located in detents in the leg. The lower end of the leg passes under the base so that upward movement of the tray relative to the seat is inhibited.

The seat structure includes a base that is substantially wider circumferentially than the rest of the seat structure. This discourages the seat structure from tilting over with the infant within it. This is also particularly important because the infant will be sitting upright with their core muscles engaged, and with a heightened center of gravity.

Despite the stability provided by the seat, an active infant may still be able to impose significant tipping forces on the seat when in use. This is made possible in part by the proper support provided for the infant that permits the engagement of the feet with the floor in front of the seat.

It is the object of the present invention to obviate or mitigate the above disadvantages.

SUMMARY OF THE INVENTION

According to one aspect of the present invention there is provided a child seat assembly comprising a seat to accommodate a child, the seat including a base for engagement with a support surface, The child seat assembly further including a mat for positioning between the base and the support surface and extending forwardly from the base in to a region occupied by the feet of a child using the chair, and a tether extending between and secured to the mat and the seat to inhibit relative movement between the seat and mat.

Preferably the tether in is releasable at either end.

As a further preference the tether engages a hook on the base.

In one embodiment, the tether is a loop on the mat that engages the hook.

In a further aspect of the invention there is provided a mat to support a child seat, the mat having oppositely directed major surfaces and a strap located within the periphery of the mat so as to provide an area of the mat to be engaged by the feet of a child in the seat, the strap projecting from the upper surface of the mat and being dimensioned to receive a hook associated with and connected to the base of the child seat.

Preferably the strap is releasably attached to the mat and as a further preference the strap is adjustable.

In the preferred embodiment, the seat assembly utilizes a tray supporting leg to secure the front of the seat. A mat is disposed beneath the seat and extends forwardly beneath the tray. The mat is connected to the seat by a tether which includes a separable fastener. The leg is secured to the tether and thereby effectively secured to the mat. For extreme movement that might otherwise tip the chair, the child will use his/her feet to push against the mat. The tether inhibits relative movement between the chair and mat and so prevents significant relative movement between the chair and mat to inhibit tipping of the chair.

An embodiment of the invention will now be described with reference to the accompanying drawings in which.

DESCRIPTION

Figure 1:
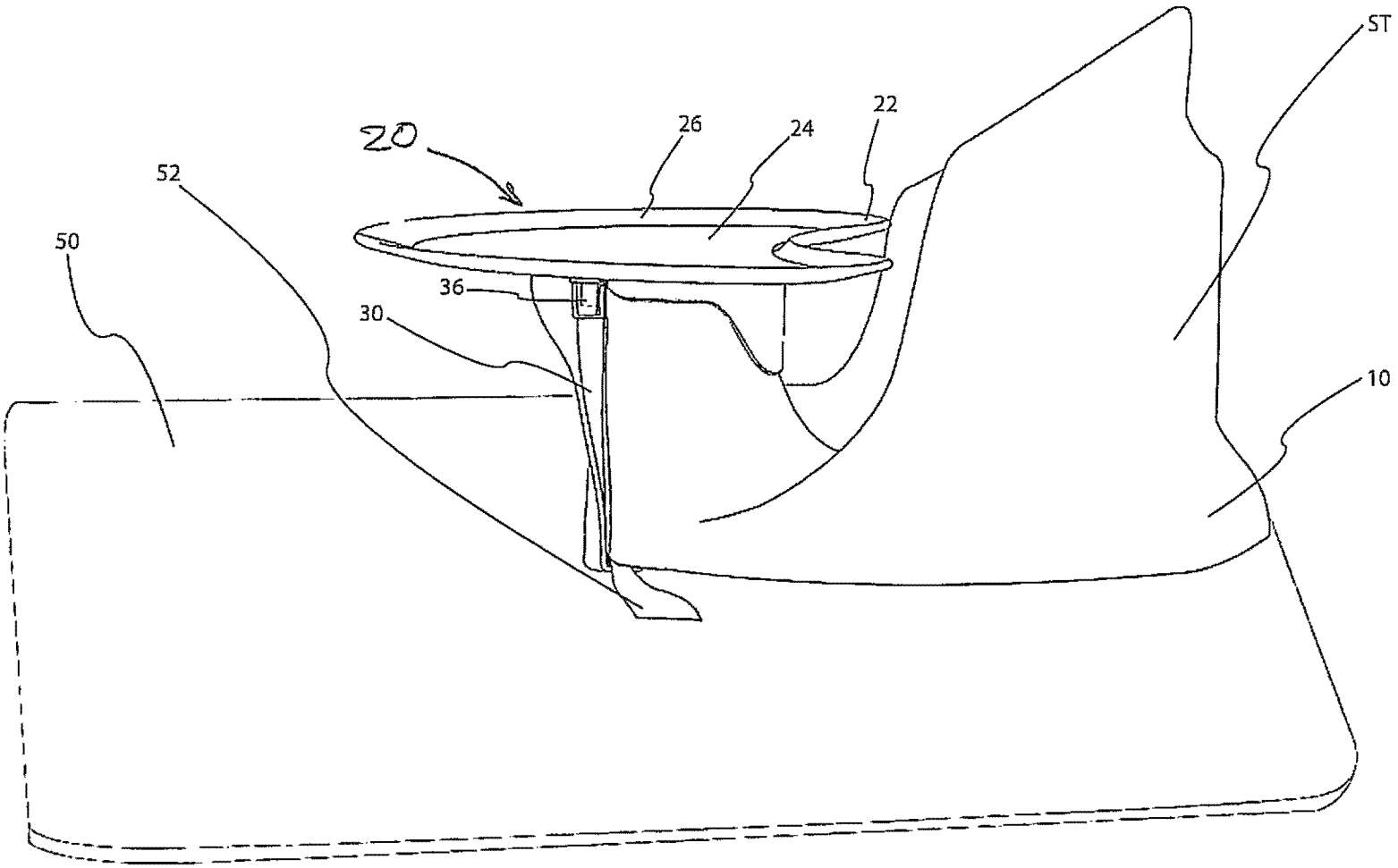
FIG. 1 is a side perspective view of one embodiment of seat structure.
Figure 2:
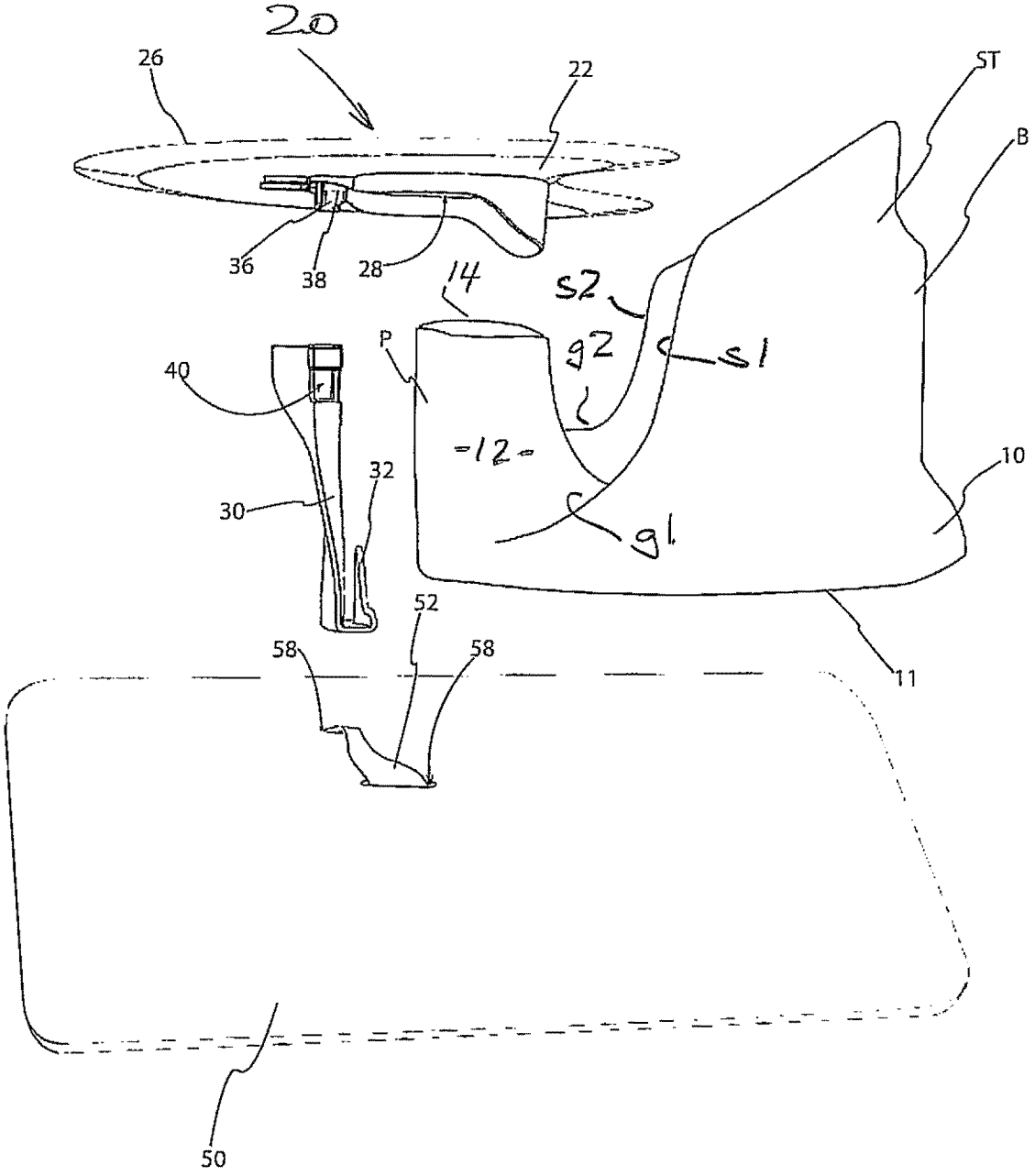
FIG. 2 is a an exploded view of the seat structure of FIG. 1.
Figure 4:
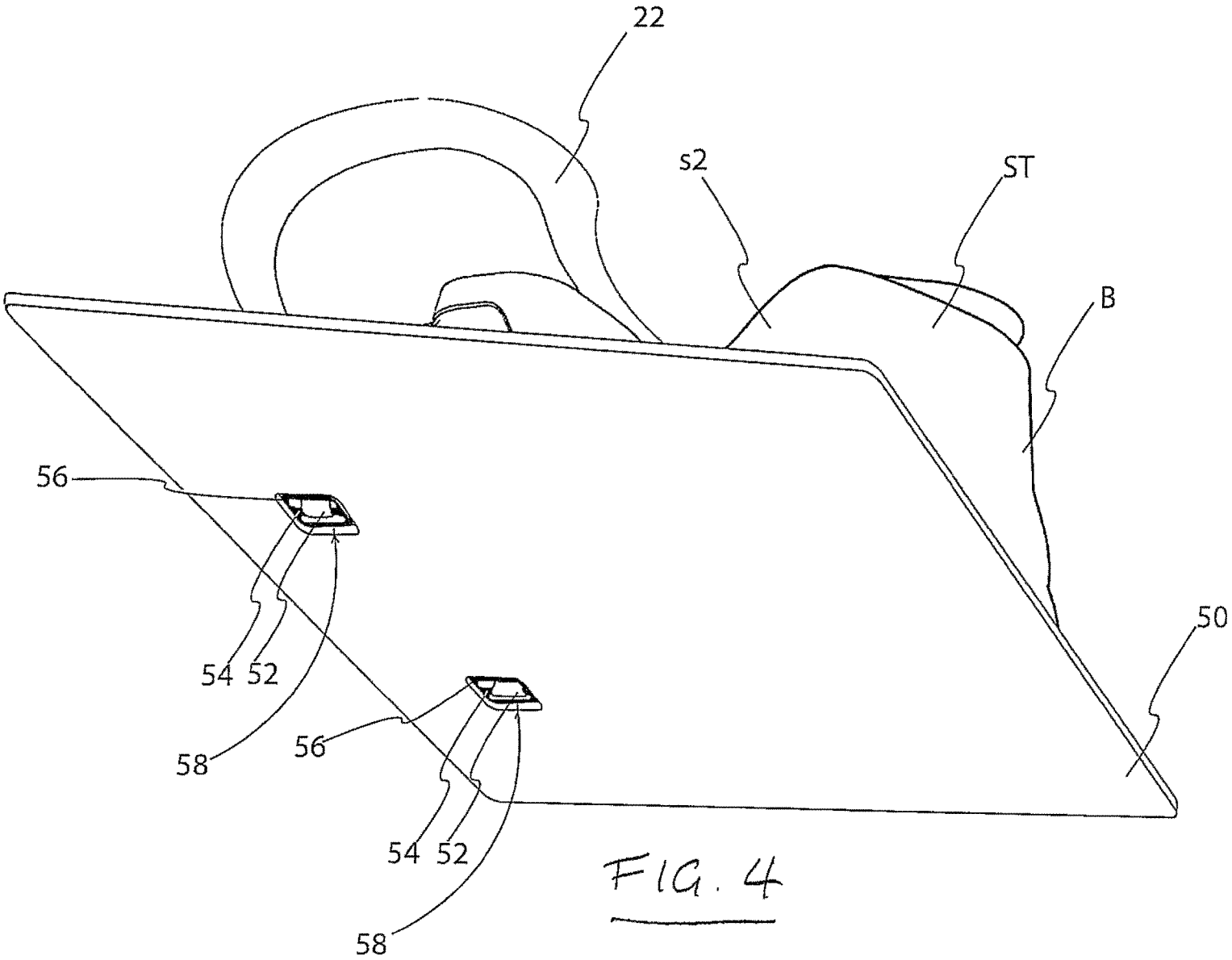
FIG. 4 is an underside perspective view of the embodiment of FIG. 1.
Figure 5:
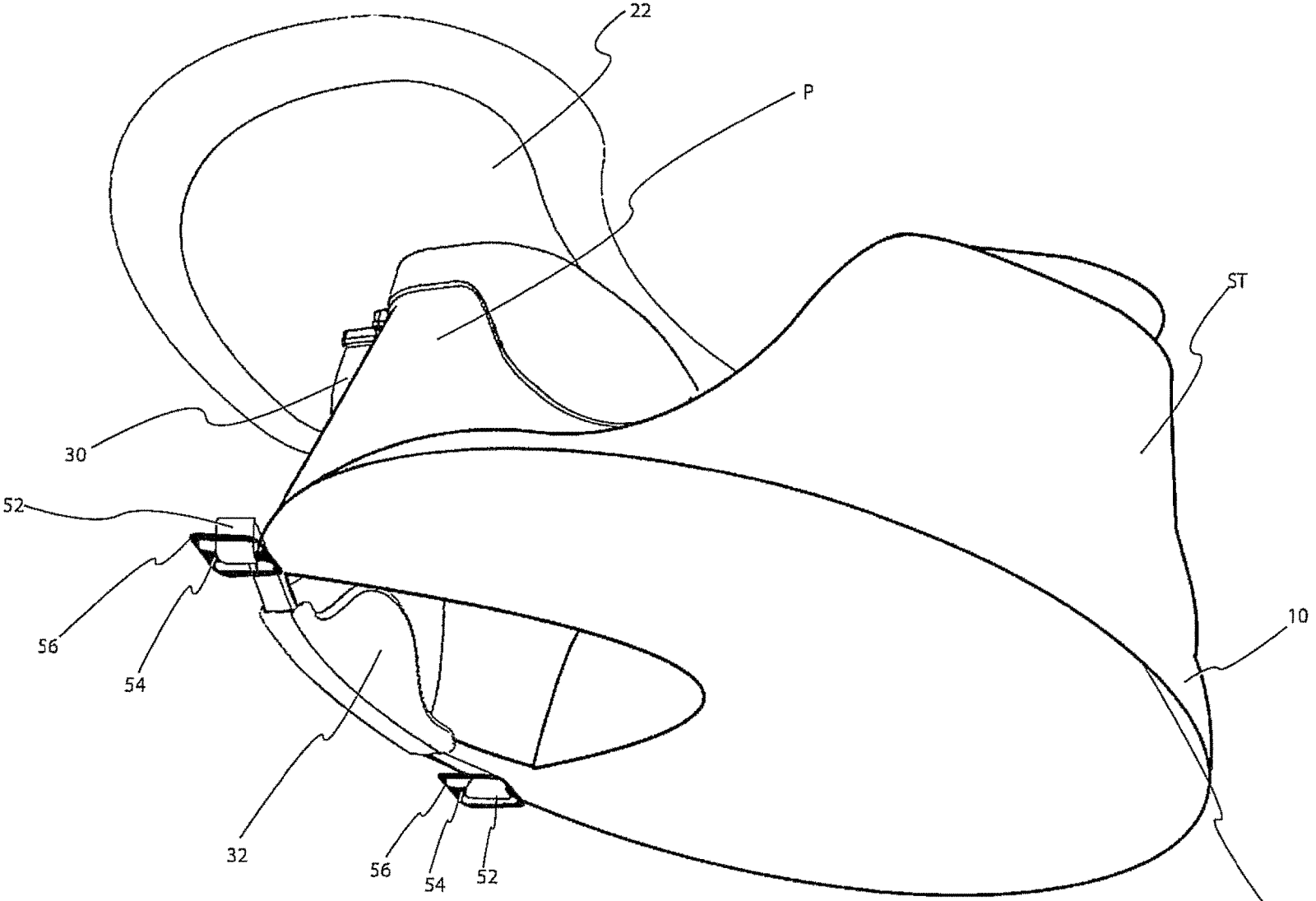
FIG. 5 is a n underside perspective view similar to FIG. 4 with a component of the seat structure removed.
Figure 6:
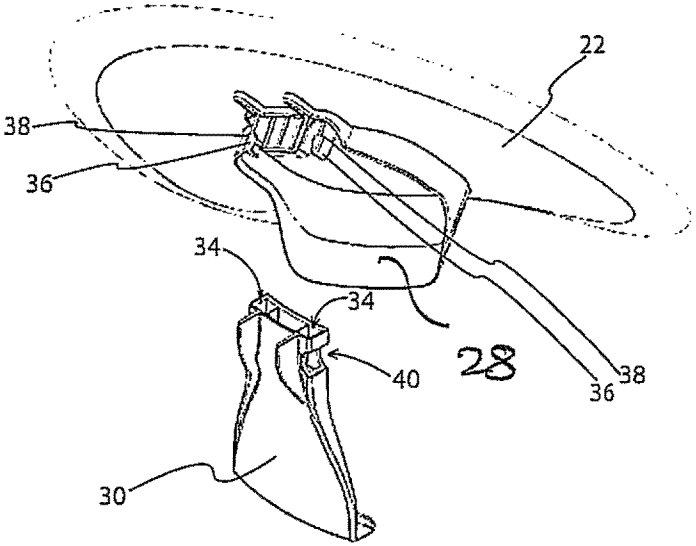
FIG. 6 is an exploded perspective view of a tray and support leg used in the seat structure of FIG. 1.
Figure 7:
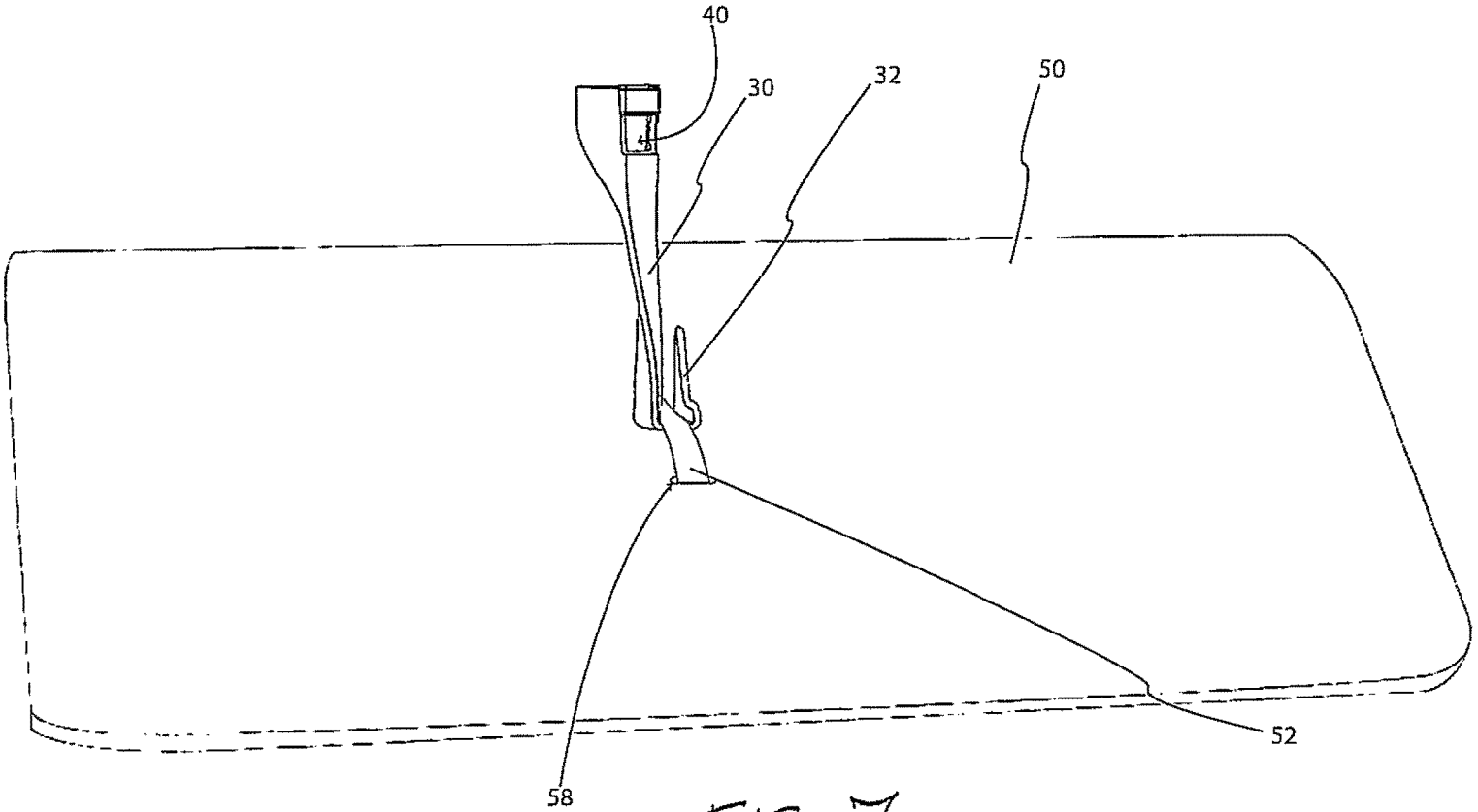
FIG. 7 is a side perspective view of a mat and leg used in the serat structure of FIG. 1.

Referring to FIGS. 1 and 2, an child seat assembly comprises an infant seat structure generally indicated, ST, a tray assembly 20 and a mat 50. The infant seat structure has a base 10 with a lower surface 11 for placement on a generally horizontal support structure, such as a chair or the floor. As can be seen in FIG. 4, the base 10 is formed with an upwardly directed generally planar seat S, and a pommel P located at a forward edge of the seat S. The seat S is forward tilted, so that in use the back of the seat S is higher than the front. An angle to the lower surface 11 of the base 10 of between 2 and 20 degrees has been found satisfactory, and between 6 and 11 is preferable. It will be appreciated that this is the average angle as the seat S may be slightly concave and curved at its outer limits to blend smoothly with the surrounding structure.

The pommel P has oppositely directed flanks 12 that diverge radially outwardly at an included angle of between 1 and 90 degrees, preferably around 30 degrees, and converge upwardly at an included angle of 1-20 degrees. The radially inner extent of the pommel, indicated at 14, does not extend inwardly beyond the leading edge of the seat S by more than a distance equivalent to half the front-to-back length of the base, 10. In a typical seat structure for infant use this would be in the order of 5 inches, but may be greater with seat structures intended for special needs or rehabilitation.

The infant seat structure ST also includes a back support B and side supports s1 and s2, as shown in FIGS. 1 and 2 as more fully described in U.S. Pat. No. 10,952,541, the contents of which are incorporated herein by reference, to support the infant's upright position. The side supports s1 and s2 diverge from the back support B and do not extend forward past the region that would normally be occupied by the infant's hip joints. Preferably, the side supports s1 and s2 diverge at a relatively wide angle of between 30 and 60 degrees to the centreline of the seat (i.e. at an included angle of between 60 and 120 degrees), and terminate at inclined leading edges 16 that do not extend forward substantially past the centre of the hip joint of an infant intended to use the seat structure. The combination of the divergent sidewalls and their relatively short length provides freedom of movement of the hip joints and therefore allows for substantial splaying of the legs. In one configuration, the radii from the center of the seat S to the leading edges 16 of the side support, as indicated by chain dot lines, subtend an included angle of between 90 and 200 degrees, preferably 160 to 190 degrees.

An infant's legs are able to project outwardly from the seat structure ST on either side of the pommel P, through spaces g1 and g2 which are situated between the flanks 12 of pommel P and the leading edges 16 of side supports s1 and s2, respectively. It will be noted that the surface of the seat S continues through the spaces g1 and g2 to the periphery of the base 10.

It is preferred that the seat is integrally molded from a durable plastic material and that the interior flanks of side supports, s1 and s2 blend smoothly with the concave seat surface S and the interior surface of the back support B. It is also preferred that the inner and side flanks of the pommel, P blend smoothly with the concave seat surface S.

Figure 3:
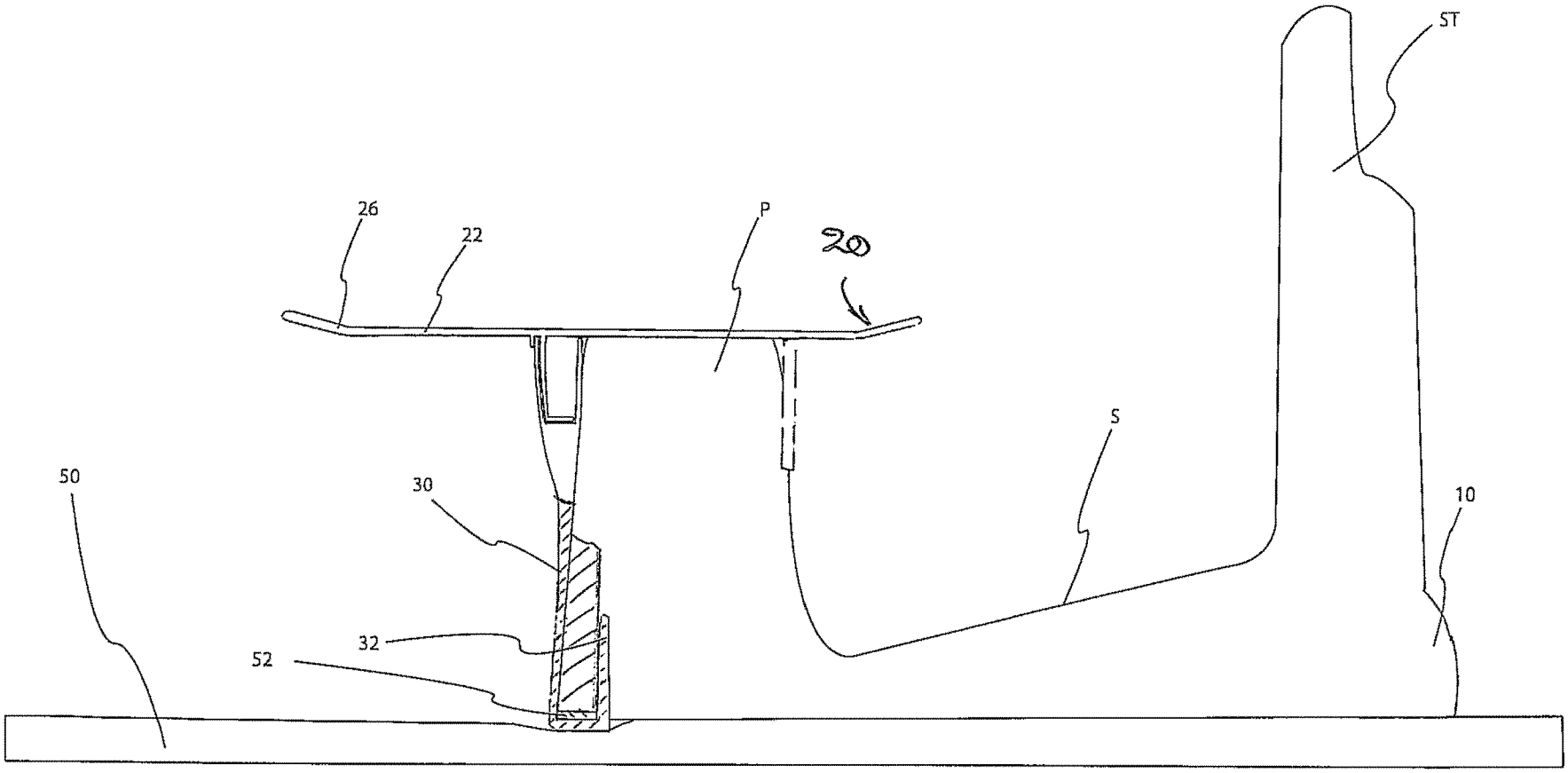
FIG. 3 is a a longitudinal section of the seat structure of FIG. 1.

A tray assembly 20 is detachably secured to the seat structure ST. The tray structure 20 has a tray 22 with a planar upper surface 24 and a raised edge 26 to contain items on the tray. A socket 28 is formed on the underside that conforms to the outer surface of the pommel P and locates the tray 22. The tray is secured to the base 10 by a leg 30. The leg 30 has an upwardly directed hook 32 on its lower end that underlies the lower edge of the base 10 as seen in FIG. 3 to prevent relative upward movement of the leg 30. The hook 32 is a friction fit on the front wall of the pommel P to offer limited resistance to relative movement between the leg 30 and the pommel P.

The upper end of the leg is formed with a cavity 34 that receives a pair of resilient fingers 36. Barbs 38 are formed on the fingers 36 and are received in openings 40 formed in the wall of the cavity 34. The openings 40 provide detents for the barbs 38 so that they can enter the openings 40 and hold the tray 22 to the leg 30 and subsequently be pushed inwardly and release the tray 22 from the leg 30.

The mat 50 has oppositely directed major faces 51 and is placed beneath the seat structure ST and extends forwardly of the base 10 beneath the tray 22. The mat 50 may be made of any suitable substrate including a rigid sheet but is preferably a carpet like material that is pliable and preferably stain resistant and readily washable.

A strap 52 is secured to the mat 50 and overlies the upper major surface of the mat 50. The strap 52 is dimensioned to fit within the bight of the hook 32. The strap 52 is secured at two laterally spaced locations to permit the hook 32 to be inserted between the mat and the strap. The strap 52 acts as a tether that extends between and is secured to the seat assembly ST and the mat 50.

The strap 52 is positioned so that the when the hook 32 is engaged with the strap 52, the mat 50 extends far enough forward to lie beneath the feet of an infant in the seat S. The mat 50 is large enough to extend under a substantial portion, preferably all, of the base 10.

As can be seen in FIG. 4, the strap 52 is attached to the central bar 54 of a buckle 56 at each end. The buckles 56 can pass through slits 58 in the mat 50 and engage the underside of the mat 50 to inhibit removal.

If preferred the strap 52 can be adjustable so as to be a snug fit in the hook 32 and hold it against the mat 50.

In use, the hook 32 is engaged with the strap 52 and seat S is placed on the mat 50 adjacent to the leg 30 so that the leg 30 abuts the front wall of the base 10. In this position the hook 32 underlies the base and inhibits upward movement of the leg 30.

The infant is placed on the seat S with legs projecting through the spaces g1, g2. The forward inclination of the seat S encourages the infant's pelvis to be tilted anteriorly when seated. This position encourages the infant's core muscles to be engaged, and for the infant to be sitting in more of an upright position. The pommel P is positioned at the forward edge of the seat S and is sized to promote splaying of the infant's legs, provide support for the infant, and maintain their position in the seat structure ST. The pommel P is also effective to prevent the infant from slipping forward in the seat S.

With the infant seated, the tray assembly 20 is secured to the seat S by inserting the socket 24 on to the pommel. As the tray 22 is placed in position, the fingers 36 are inserted into the cavity 34 and the barbs 38 engage the openings 40 to prevent the tray 22 from being removed from the pommel.

With the seat ST on the floor, the outer surfaces of the sitting infant's feet/ankles/heels are able to rest on the mat 50. This encourages bending of the knees and splaying of the infant's legs with external hip rotation and abduction. The configuration of the side supports s1, s2, as described above facilitates the splaying of the legs that is promoted by the pommel P.

Notwithstanding the configuration of the base, the engagement of the infant's feet with the floor can provide a purchase for the infant so that sufficient force can be exerted to lift the front of the base and produce a degree of instability to the seat S. If such a force is applied the hook 32 engages the strap 52 which acts as a tether to inhibit upward movement relative to the mat 50. The vertical force is transferred to the tray 22 through the fingers 36 and the socket 24 is pulled on to the pommel. As the infant's feet are effectively holding the mat in position, there is limited relative movement between the seat S and the mat 50 so the stability of the seat S is maintained.

If the tray 22 is detached with the infant in the seat ST, the frictional fit between the hook 32 and the pommel P is sufficient to inhibit movement and resist rearward tipping of the seat structure ST.

I claim:

1. A child seat assembly comprising a seat to accommodate a child, the seat including a base for engagement with a support surface, said child seat assembly further including a mat for positioning between the base and the support surface and extending forwardly from the base in to a region occupied by the feet of a child using the chair, and a tether extending between and secured to the mat and the seat to inhibit relative movement between the seat and mat, wherein the tether is secured to said mat, wherein a hook is provided on said seat and said tether engages said hook to connect said mat and said seat, and wherein said hook is provided at a lower end of a leg that extends along an outer surface of the base.

2. The child seat assembly according to claim 1 wherein the tether is connected to the mat at spaced locations to provide a loop that is engaged by the hook.

3. The child seat assembly according to claim 2 wherein said tether is adjustable to vary the dimensions of said loop.

4. The child seat assembly according to claim 1 wherein the tether is releasably connected to said mat.

5. The child seat assembly according to claim 1 wherein said hook engages a lower edge of said base.

6. The child seat assembly according to claim 5 wherein said hook is dimensioned to provide a frictional fit on the lower edge of said base and inhibit relative movement between said tether and said base.

7. The child seat assembly according to claim 5 wherein said leg is releasably secured to a table assembly supported on said base so as to inhibit relative movement of said table toward said mat with said hook inhibiting movement of said table assembly away from said mat.

8. The child seat assembly according to claim 2 wherein said tether is a strap overlying a portion of said mat and secured at spaced locations thereto.

9. The child seat assembly of claim 8 wherein said strap passes through said mat at each of said spaced locations.

10. The child seat assembly according to claim 9 wherein said strap is detachably secured to said mat at said spaced locations.

* * * * *